US009190701B2

(12) United States Patent
Snyder et al.

(10) Patent No.: US 9,190,701 B2
(45) Date of Patent: Nov. 17, 2015

(54) IN-LINE PSEUDOELLIPTIC $TE_{01(n\delta)}$ MODE DIELECTRIC RESONATOR FILTERS

(71) Applicant: RS MICROWAVE COMPANY, Butler, NJ (US)

(72) Inventors: Richard V. Snyder, Kinnelon, NJ (US); Simone Bastioli, Rutherford, NJ (US)

(73) Assignee: RS Microwave Company, Butler, NJ (US)

( * ) Notice: Subject to any disclaimer, the term of this patent is extended or adjusted under 35 U.S.C. 154(b) by 289 days.

(21) Appl. No.: 13/792,576

(22) Filed: Mar. 11, 2013

(65) Prior Publication Data

US 2013/0328644 A1 Dec. 12, 2013

Related U.S. Application Data

(60) Provisional application No. 61/658,544, filed on Jun. 12, 2012.

(51) Int. Cl.
*H01P 1/219* (2006.01)
*H01P 1/208* (2006.01)

(52) U.S. Cl.
CPC ..... *H01P 1/219* (2013.01); *H01P 1/2086* (2013.01)

(58) Field of Classification Search
CPC ..... H01P 1/219; H01P 1/2086; H01P 1/201
USPC ..... 333/202–212, 219.1
See application file for complete search history.

(56) References Cited

U.S. PATENT DOCUMENTS 3,639,862 A * 2/1972 Craven ..... H01P 1/219 333/210
4,642,591 A 2/1987 Kobayashi
4,746,883 A * 5/1988 Sauvage et al. ..... 333/202
5,083,102 A * 1/1992 Zaki ..... H01P 1/2086 333/202

(Continued)

OTHER PUBLICATIONS

Simone Bastioli; and Richard V. Snyder, "In-Line Pseudoelliptic TE01δ Mode Dielectric Resonator Filters Using Multiple Evanescent Modes to Selectively By-Pass Orthogonal Resonators", IEEE, IMS 2012 Paper No. 1184, Jul. 10, 2012.

(Continued)

*Primary Examiner* — Benny Lee
*Assistant Examiner* — Rakesh Patel
(74) *Attorney, Agent, or Firm* — RatnerPrestia

(57) ABSTRACT

The present invention uses $TE_{01(n\delta)}$ single-mode resonators in different orientations that are cascaded along an evanescent mode waveguide. By exploiting multiple orthogonal evanescent modes that can alternatively by-pass, or excite the resonators, cross-coupling between non-adjacent resonators is established and properly controlled. Pseudoelliptic filters are realized without using cumbersome cross-coupled architectures, or reduced spurious performance multi-mode resonators. A $6^{th}$ order filter with two transmission zeros in the lower stopband, a $5^{th}$ order filter with three transmission zeros, and an $8^{th}$ order filter with four transmission zeros are included as embodiments of the present invention.

11 Claims, 20 Drawing Sheets

(56) References Cited

U.S. PATENT DOCUMENTS

| | | | | |
|---|---|---|---|---|
| 2002/0041221 | A1 | 4/2002 | Abdulnour | |
| 2006/0186972 | A1 * | 8/2006 | Pance | H01P 1/2084 333/235 |

OTHER PUBLICATIONS

S. La Casta Munoa, Authorized Officer of EPO, International Search Report for PCT/US2013/043253 Dated Sep. 6, 2013.

* cited by examiner

APPROVED

IN-LINE PSEUDOELLIPTIC $TE_{01(n\delta)}$ MODE DIELECTRIC RESONATOR FILTERS

FIELD OF THE INVENTION

The present invention relates, in general, to microwave filters. More specifically, the present invention relates to dielectric resonator filters that are cascaded in-line, along an evanescent mode waveguide.

BACKGROUND OF THE INVENTION

Dielectric resonators are widely employed in modern microwave communication systems, because of their compactness and superior performance in terms of Q-factor and temperature stability. Most common dielectric-loaded cavity filters employ high permittivity cylindrical disks (or pucks) suspended within a metallic enclosure and operating in their fundamental $TE_{01\delta}$ mode, or in a higher order $HE_{11\delta}$ mode. Conventionally, the pucks are axially located along the metallic enclosure, or mounted in a planar configuration, as shown in FIGS. 1A and 1B.

The $HE_{11\delta}$ dual-mode resonators allow for compact in-line structures, and are extensively used for satellite applications, in which the number of physical cavities used in a filter structure can be reduced. Pseudoelliptic responses can be obtained by achieving cross-coupling among the modes of adjacent resonators. In particular, the various modes are usually coupled, in order to obtain quadruplets of resonators, thus yielding symmetric responses.

The $TE_{01\delta}$ single-mode cross-coupled filters with planar layouts enable extended design flexibility for achieving both symmetric and asymmetric pseudoelliptic responses; they also provide higher spurious performance over dual-mode filters at the expense of size and mass. For these reasons, as well as design simplicity, the $TE_{01\delta}$ single-mode cross-coupled filters are among the most common dielectric resonator filters, especially for terrestrial applications. Although the in-line topology is convenient for mechanical and size considerations, $TE_{01\delta}$ single-mode filters with in-line structure are not used for applications requiring minimum volume or resonator count, for critical specifications, due to their inability to yield pseudoelliptic responses.

The present invention addresses new configurations of $TE_{01\delta}$ single-mode filters that implement pseudoelliptic responses, within an in-line structure. As will be explained, the present invention uses single-mode $TE_{01\delta}$ dielectric resonators with different orientations, that are cascaded along an evanescent mode waveguide. Dielectric resonators operating in the higher order $TE_{01(n\delta)}$ modes (i.e. nth order harmonic resonances) can be used as well.

BRIEF DESCRIPTION OF THE FIGURES

The invention may be understood from the following detailed description when read in connection with the accompanying figures.

SUMMARY OF THE INVENTION

Figure 1B:
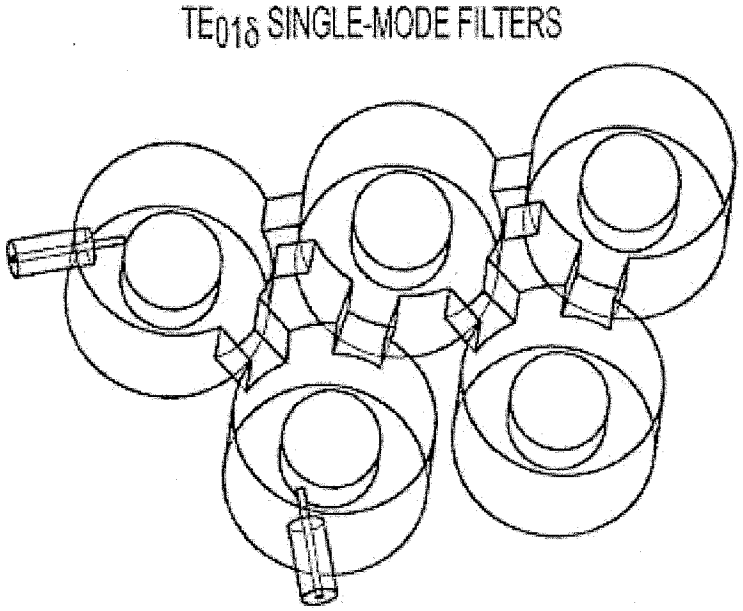
FIG. 1B PRIOR ART
FIG. 1B is a perspective view of a conventional $TE_{01\delta}$ single-mode filter.
Figure 1A:
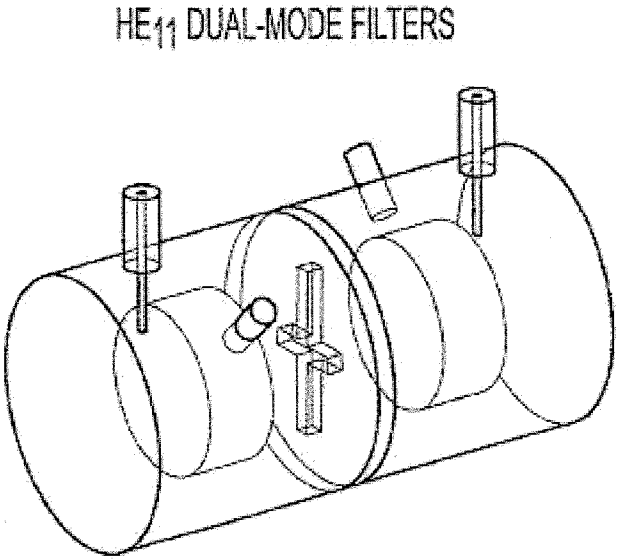
FIG. 1A PRIOR ART
FIG. 1A is a perspective view of a conventional $HE_{11\delta}$ in-line, dual-mode filter.

To meet this and other needs, and in view of its purposes, the present invention provides a filter comprising an evanescent mode waveguide formed along a straight line and configured to receive at least two waveguide modes. A first dielectric resonator is disposed in the waveguide, and configured to be excited by one of the two waveguide modes, where the first dielectric resonator has an excited field oriented in a first plane that intersects with the straight line. A second dielectric resonator is disposed in the waveguide, and configured to be excited by the other one of the two waveguide modes, where the second dielectric resonator has an excited field oriented in a second plane that intersects with the straight line. The first and second planes intersect the straight line at different angles. A third dielectric resonator is disposed in the waveguide and configured to be substantially excited by the same waveguide mode as the first dielectric resonator, where the third dielectric resonator has an excited field oriented in a third plane that intersects with the straight line The first and third planes are substantially parallel to each other.

The second dielectric resonator is disposed between the first and third dielectric resonators. The second dielectric resonator is electromagnetically coupled to the first and third dielectric resonators. In addition, the first and third dielectric resonators are electromagnetically coupled to each other.

The filter may include a first perturbation element extending from an external surface of the waveguide into the waveguide, where the first perturbation element is disposed between the first and second dielectric resonators. A second perturbation element may extend from the external surface of the waveguide into the waveguide, where the second perturbation element is disposed between the second and third dielectric resonators. The first and second perturbation elements may be configured to excite the second dielectric resonator in a mode that is the other of the mode that excites the first and third dielectric resonators.

The first perturbation element may be a first metallic rod oriented at a positive or negative angle with respect to the first dielectric resonator. The second perturbation element may be a second metallic rod oriented at a positive or negative angle with respect to the third dielectric resonator. The first and second metallic rods may be substantially oriented at a positive or a negative 45 degree angle with respect to the first and third dielectric resonators, respectively. A penetration distance, p, of the first and second metallic rods into the waveguide is effective in controlling an amount of electromagnetic coupling between the first and second dielectric resonators, and between the second and third dielectric resonators, respectively. The longer is the penetration distance p, the greater is the amount of electromagnetic coupling.

A distance, d, between a center of the first dielectric resonator and a center of the third dielectric resonator is effective in controlling an amount of electromagnetic coupling between the first and third dielectric resonators. The shorter is the distance d, the greater is the amount of electromagnetic coupling.

Another embodiment of the present invention is a dielectric resonator filter comprising: first, second, third and fourth dielectric resonators cascaded along a straight line, and disposed in an evanescent mode waveguide. The first and fourth dielectric resonators are substantially parallel to each other, the second and third dielectric resonators are substantially parallel to each other. The first and second dielectric resonators are oriented at different angles along the straight line. At least a pair of non-adjacent dielectric resonators are electromagnetically coupled to each other.

A first perturbation element may extend from an external surface of the waveguide into the waveguide, where the first perturbation element is disposed between the first and second resonators. A second perturbation element may extend from the external surface of the waveguide into the waveguide, where the second perturbation element is disposed between the third and fourth resonators. The first and fourth dielectric resonators are electromagnetically coupled to each other, and the second and third dielectric resonators are electromagnetically coupled to the first and fourth dielectric resonators, respectively.

Yet another embodiment of the present invention is a dielectric resonator filter comprising: (a) first, second, third, fourth and fifth dielectric resonators cascaded along a straight line, and (b) the dielectric resonators disposed in an evanescent mode waveguide. The first and fifth resonators are substantially parallel to each other. The second and fourth resonators are substantially parallel to each other. The first and second resonators are oriented at different angles along the straight line. The third resonator is oriented at an angle that is different from either the first and second resonators. A first perturbation element may extend from an external surface of the waveguide into the waveguide, where the first perturbation element is disposed between the first and second resonators. A second perturbation element may extend from the external surface of the waveguide into the waveguide, where the second perturbation element is disposed between the second and third resonators. A third perturbation element may extend from the external surface of the waveguide into the waveguide, where the third perturbation element is disposed between the third and fourth resonators. A fourth perturbation element may extend from the external surface of the waveguide into the waveguide, where the fourth perturbation element is disposed between the fourth and fifth resonators. At least a pair of non-adjacent dielectric resonators may be electromagnetically coupled to each other.

It is understood that the foregoing general description and the following detailed description are exemplary, but are not restrictive, of the invention.

DETAILED DESCRIPTION OF THE INVENTION

The present invention includes using single-mode $TE_{01\delta}$ dielectric resonators (or $TE_{01(n\delta)}$ mode, with arbitrary n) with different orientations that are cascaded along an evanescent mode waveguide. By using a pair of orthogonal waveguide evanescent modes, namely $TE_{10}$ and $TE_{01}$, which can excite or by-pass the resonators, cross-coupling between non-adjacent pucks is established and properly controlled. Compared to $HE_{11\delta}$ and $TE_{01\delta}$ mode filters, the present invention maintains a convenient in-line structure of the former, while having the flexibility and spurious performance of the latter.

Figure 2A:
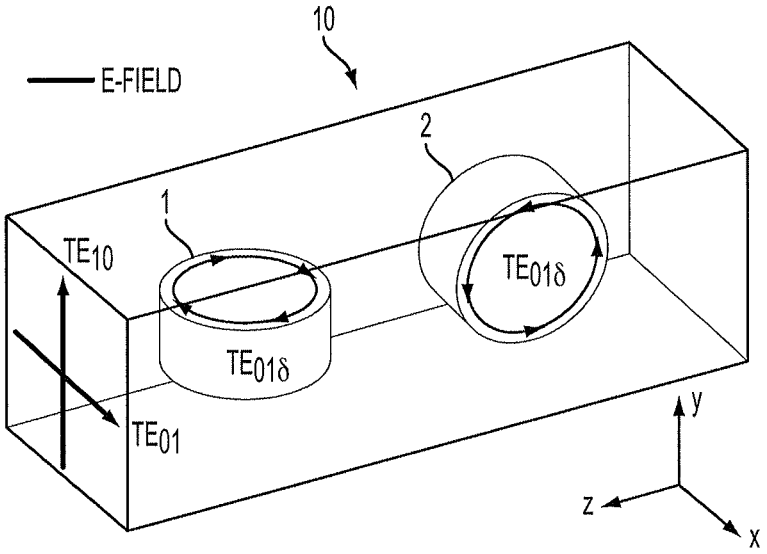
FIG. 2A is a perspective view of an evanescent waveguide with two orthogonally oriented dielectric resonators, in accordance with an embodiment of the present invention.
Figure 2B:
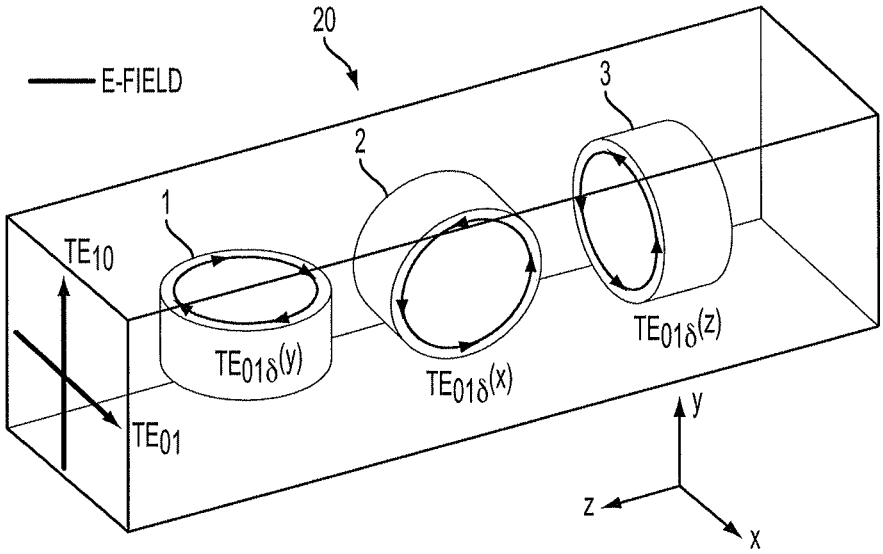
FIG. 2B is a perspective view of an evanescent waveguide with three orthogonally oriented dielectric resonators, in accordance with an embodiment of the present invention.

The present invention may be understood by considering the structures illustrated in FIGS. 2A and 2B. FIG. 2A shows two dielectric resonators having different orientations cascaded along an evanescent mode square waveguide 10. FIG. 2B shows three dielectric resonators with different orientations, also cascaded along an evanescent mode square waveguide 20.

Referring first to FIG. 2A, the E-field of the $TE_{01\delta}$ mode in the first dielectric resonator (labelled 1) lies on the xz plane. Such a field is parallel to that of the $TE_{01}$ mode of the waveguide, while being orthogonal with respect to the field of the $TE_{10}$ mode. As a result, the $TE_{01}$ mode can excite the resonator, while the $TE_{10}$ mode cannot. The latter can only by-pass the resonant mode of the first dielectric resonator, which is seen as a simple dielectric obstacle. Analogous considerations are applied to the second dielectric resonator (labelled 2), where the resonant $TE_{01\delta}$ mode is excited by the $TE_{10}$ mode and is by-passed by the $TE_{01}$ mode.

In this condition, the two dielectric resonators are, therefore, isolated from each other. By introducing proper waveguide discontinuities, such as field perturbations, coupling mechanisms may be established. Direct-coupling and cross-coupling may be properly realized due to the by-pass coupling of the two waveguide evanescent modes.

Referring next to FIG. 2B, there is shown three dielectric resonators with three different orthogonal orientations cascaded along an evanescent mode waveguide with square cross-section. The resonant modes of the dielectric resonators, as well as the evanescent modes of the waveguide, are indicated in the figure by their E-fields. In the following explanation, the coupling relationships between resonant and waveguide modes are described by considering the orientation and the symmetry of the E-fields of the various modes. This is an arbitrary choice, as the same conclusions can be derived by considering the H-fields as well.

The E-field of the mode resonating in the first resonator (labelled 1 in FIG. 2B), referred to as $TE_{01\delta}^{(y)}$ to indicate the y-axis orientation, lies on the xz plane. Such a field is parallel to that of the $TE_{01}$ mode of the waveguide, while being orthogonal with respect to the field of the $TE_{10}$ mode. As a result, the $TE_{01}$ mode can excite the resonator, while the $TE_{10}$ mode cannot. The latter can only by-pass the resonant mode of the first dielectric resonator, which is seen as a simple dielectric obstacle. Opposite considerations may be applied to the second dielectric resonator (labelled 2 in FIG. 2B), which is oriented along the x-axis. The resonant mode $TE_{01\delta}^{(x)}$ of the second resonator can be excited by the $TE_{10}$ mode, and by-passed by the $TE_{01}$ mode.

In contrast with the previous cases, neither $TE_{10}$ nor $TE_{01}$ modes can excite the resonant mode $TE_{01\delta}^{(z)}$ of the third dielectric resonator (labelled 3 in FIG. 2B), which is located at the center of the waveguide cross-section. Although the E-fields of the resonant mode $TE_{01\delta}^{(z)}$ and of the evanescent modes $TE_{10}$ and $TE_{01}$ all lie on the xy plane, due to symmetry reasons no coupling occurs among these modes. Specifically, the resonant mode $TE_{01\delta}^{(z)}$ has odd symmetry with respect to both x and y axis, while the modes $TE_{01}$ and $TE_{10}$ have even symmetry with respect to the x and y axis, respectively. These two evanescent modes will by-pass the third dielectric resonator, while other TE modes with odd symmetry, such as $TE_{20}$ and $TE_{02}$, can excite the resonator.

It will be appreciated that the three dielectric resonators are isolated from each other, because they are substantially orthogonal to each other and, consequently, none of the evanescent modes can excite more than one resonator at the same time. Under these conditions, the three dielectric resonators are isolated from each other. By introducing proper waveguide discontinuities, such as field perturbations, or by changing the position of the dielectric resonators (proper rotation and/or offset) coupling mechanisms may be established. It will be further appreciated that coupling mechanisms may be established by orienting the dielectric resonators to lie in planes that are not orthogonal to each other. Either (or both) direct-coupling and cross-coupling may be properly realized by proper orientations of the dielectric resonators.

Moreover, although only the $TE_{10}$, $TE_{01}$, $TE_{20}$, and $TE_{02}$ modes have been considered (lower order modes providing most of the contribution), the above considerations hold true for all of the higher order modes of the waveguide.

Figure 3A:
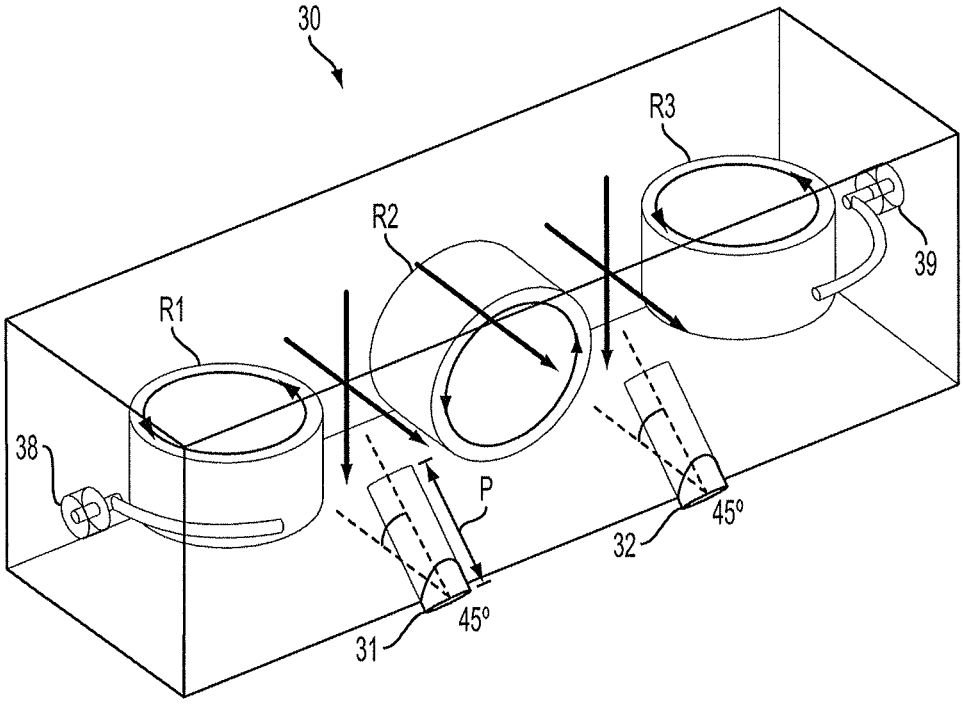
FIG. 3A is a perspective view of a triple resonator configuration in an evanescent waveguide with two parallel metallic rods oriented at 45 degrees with respect to a horizontal plane of the waveguide, thereby providing negative coupling between the first and third resonator, in accordance with an embodiment of the present invention.
Figure 3B:
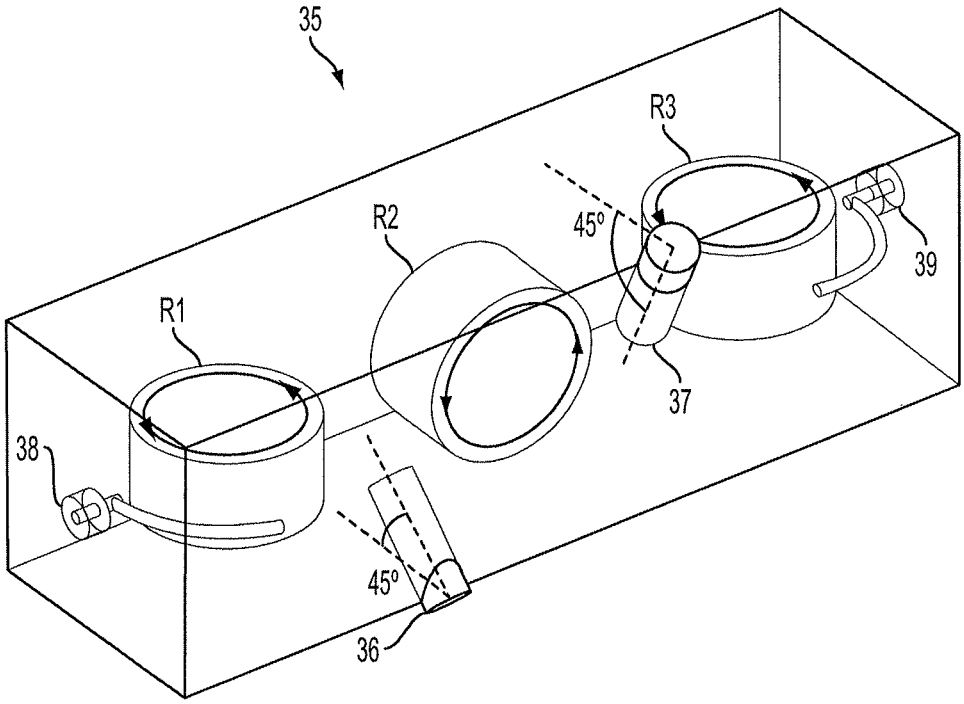
FIG. 3B is a perspective view of the same triple resonator shown in FIG. 3A, except that the two metallic rods are inverted, as they are oriented at +45 degrees and at −45 degrees with respect to the horizontal plane of the waveguide, thereby providing positive coupling between the first and third resonator, in accordance with an embodiment of the present invention.

Among the various embodiments that may be implemented by the present invention, two structures are shown in FIGS. 3A and 3B, as examples of basic building blocks for pseudoelliptic filter design. Each waveguide structure 30, 35 includes three dielectric resonators, designated in sequence as R1, R2 and R3, in which the inner resonator R2 has an orthogonal orientation with respect to the outer resonators R1 and R3. The outer resonators R1 and R3 are oriented along the same axis. In the examples of FIGS. 3A and 3B, the outer resonators are oriented along the y-axis and the inner resonator R2 is oriented along the x-axis. Metallic rods 31 and 32 are oriented at the same 45 degree angle (also referred to as parallel rods) in FIG. 3A, while metallic rods 36 and 37 are oriented at opposite 45 degree angles with respect to a center line extended along a width dimension of structure 35 (also referred to as inverted rods) in FIG. 3B. Input and output probes 38 and 39, respectively, are also shown in FIGS. 3A and 3B. It will be understood that other orientations, such as z-axis for the inner or the outer resonators, are also possible and lead to the same results.

Figure 3C:
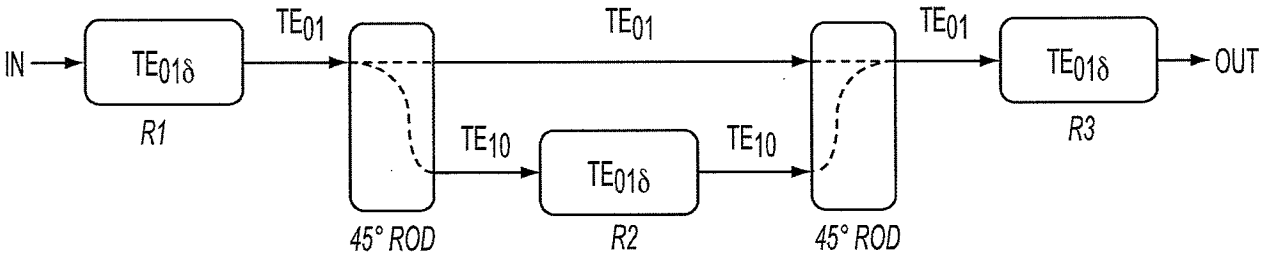
FIG. 3C is a schematic diagram showing the electromagnetic coupling among the various elements in the triple resonator configuration of FIG. 3A, in accordance with an embodiment of the present invention.

The mode operation within waveguide structures 30, 35 is illustrated by the block diagram in FIG. 3C. The input and output probes excite the resonant mode in the first (R1) and last (R3) resonators, respectively. The first and last resonators are coupled by the evanescent $TE_{01}$ mode, which by-passes the second resonator (R2). Metallic rods with 45 degree orientation are used to generate a coupling between the $TE_{01}$ and the $TE_{10}$ modes of the waveguide. In this way, part of the energy is transferred to the second resonator R2, which is excited by the $TE_{10}$ mode, as shown in FIG. 3C.

The resulting topology, shown in FIGS. 3A, 3B and 3C, may be referred to as a triplet configuration, which generates $3^{rd}$ order filtering functions with a transmission zero that can be located either below, or above the passband, depending on the sign (positive or negative) of the by-pass coupling, as explained below.

Both positive and negative signs can be obtained by inverting the phase of the excited field at the outer resonators in the direct-path with respect to the phase of the by-passing mode. In practice, this may be accomplished by moving the second 45 degree rod from the bottom to the top wall of the waveguide, as shown in FIG. 3B by rod 37. The latter configuration is referred to herein as inverted rods, as compared to the configuration of parallel rods shown in FIG. 3A.

Figure 4A:
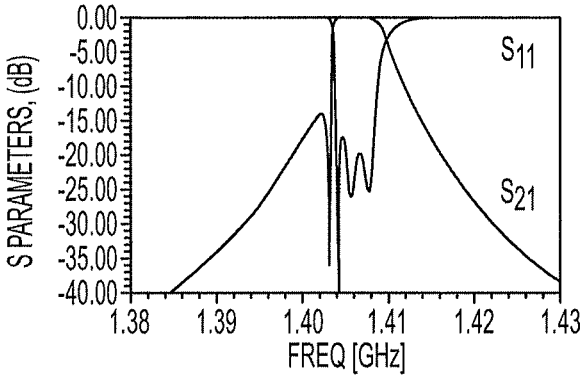
FIG. 4A is a plot of S parameters versus frequency for the triple resonator configuration shown in FIG. 3A, in accordance with an embodiment of the present invention.
Figure 4B:
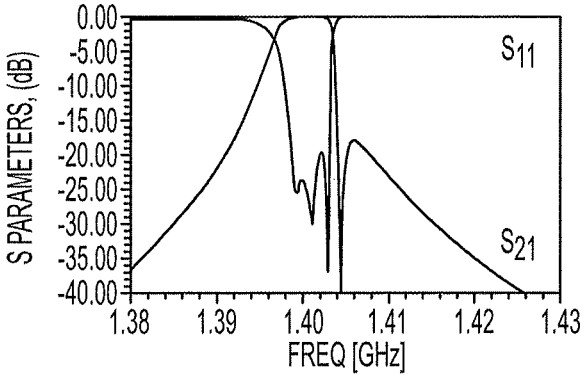
FIG. 4B is a plot of S parameters versus frequency for the triple resonator configuration shown in FIG. 3B, in accordance with an embodiment of the present invention.

FIGS. 4A and 4B depict HFSS simulations (lossless) of the two filter configurations (shown in FIGS. 3A and 3B, respectively) having a transmission zero in the lower and upper stopband, respectively. It will be appreciated that these figures represent transfer characteristics (or S-parameters) that show the frequency response of the two filters constructed in accordance with the present invention. Transfer characteristics, such as those shown in FIGS. 4A and 4B, are typically generated using equipment such as a network analyzer. The output signal from the network analyzer is generally coupled into an input port. As the network analyzer generates the output signal, it measures a signal at another port (e.g., the output port). The network analyzer then computes a ratio of the output signal at each frequency. Two typical measurements performed by the network analyzer are $S_{21}$ (insertion loss), which is a ratio of a signal output from port 2 (e.g., the output port) to a signal input to port 1 (e.g., the input port); and $S_{11}$ (return loss), which is a ratio of a signal output form port 1 (e.g., the input port) to a signal input to port 1 (e.g., the input port).

Accordingly, FIG. 4A shows the simulated S-parameters of the configuration shown in FIG. 3A (the triple-resonator configuration with parallel rods). FIG. 4B shows the simulated S-parameters of the configuration shown in FIG. 3B (the triple-resonator configuration with inverted rods).

The size of each 45 degree rod, in FIGS. 3A and 3B, adjusts the direct-coupling between one resonator and its adjacent resonator, namely, the more penetration, the stronger the coupling. The distance between the resonators impacts the by-pass coupling without significantly affecting the direct-coupling. As a result, the position of the transmission zero may be adjusted, while maintaining a consistent passband.

Figure 5A:
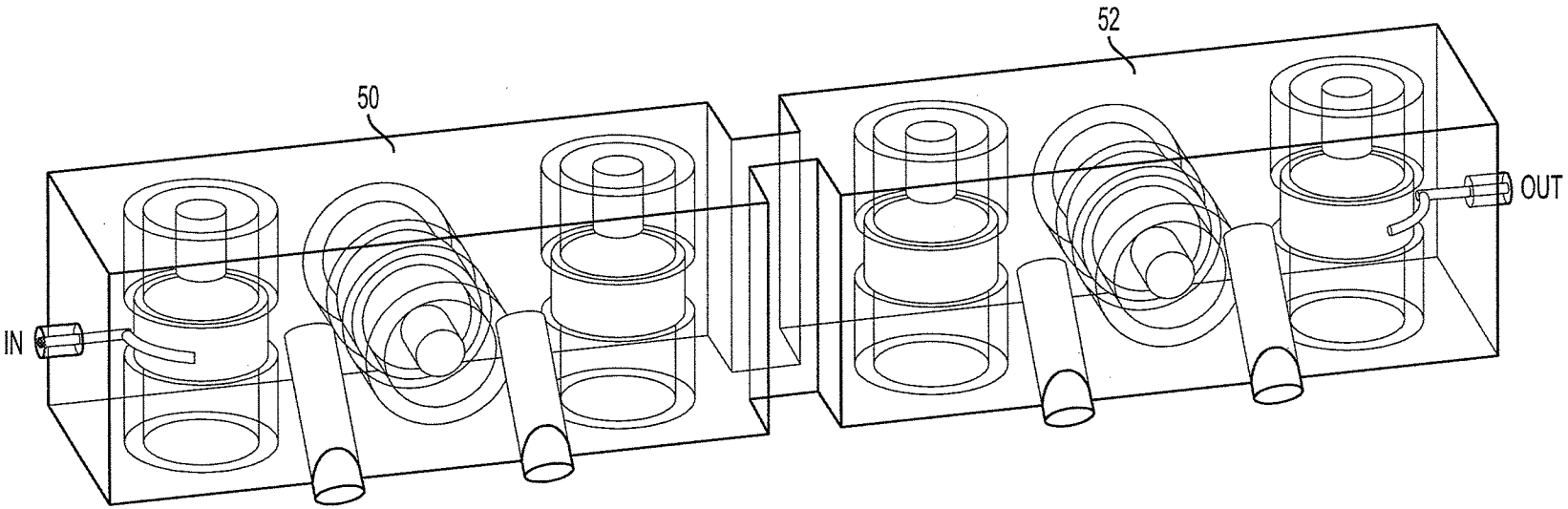
FIG. 5A is a perspective view of two-triple resonator configurations that are cascaded in-line, thereby providing a $6^{th}$ order filter, in accordance with an embodiment of the present invention.
Figure 5B:
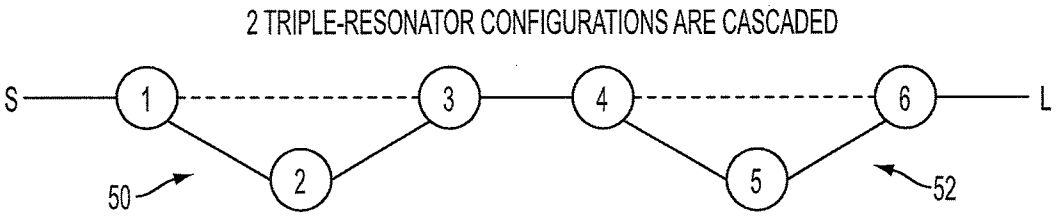
FIG. 5B is a schematic diagram showing cascading of the various elements in the $6^{th}$ order filter shown in FIG. 5A, in accordance with an embodiment of the present invention.

In another embodiment of the present invention, FIGS. 5A and 5B show a $6^{th}$ order filter that uses two triplet configurations, designated as structures 50 and 52. The filter structure cascades triplet structure 50 and triplet structure 52, as shown in FIG. 5B.

Figure 6:
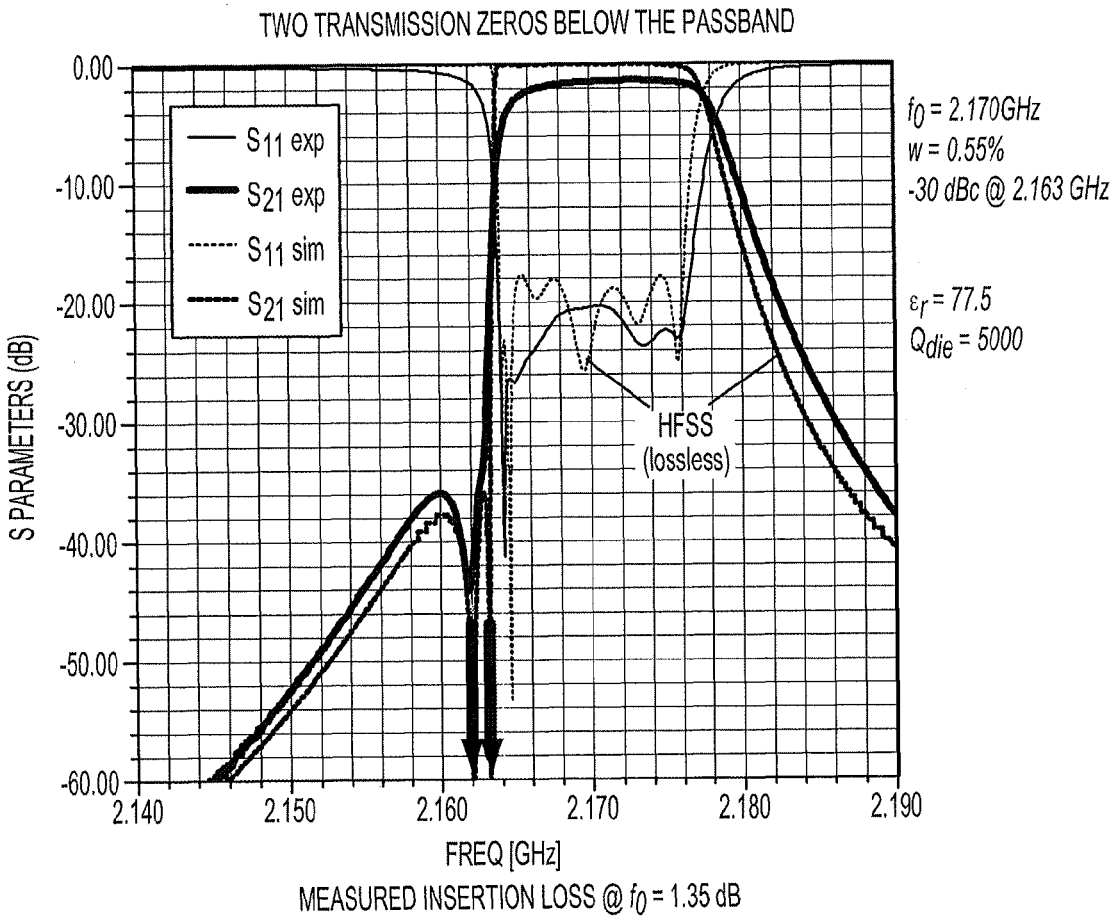
FIG. 6 is a plot of S parameters versus frequency for the two-triple resonator configurations shown in FIG. 5*a* and 5*b*, including experimental results and simulated results, in accordance with an embodiment of the present invention.

An HFSS simulation (lossless) and an experimental result for the two triplet configurations of FIG. 5A are depicted in FIG.6. The filter structure includes low-permittivity dielectric supports and tuning elements. The filter has 0.55% fractional bandwidth at 2.170 GHz and provides high selectivity at the lower stopband, due to a pair of transmission zeros. High permittivity dielectric pucks with 5000 Q-factor are included. The measured insertion loss is 1.35 dB at the filter center frequency.

The coupling coefficients of the waveguide structure can be controlled by adjusting the distances between the resonators, as well as the dimensions of the oblique rods.

Figure 8:
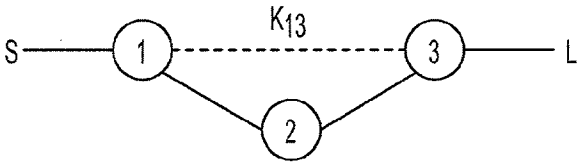
FIGS. 7, 8 and 9 describe one form of electromagnetic coupling control for the triple resonator configurations of FIGS. 3A and 3B, in which the overall distance between resonators, d, is varied, in accordance with an embodiment of the present invention.
Figure 9:
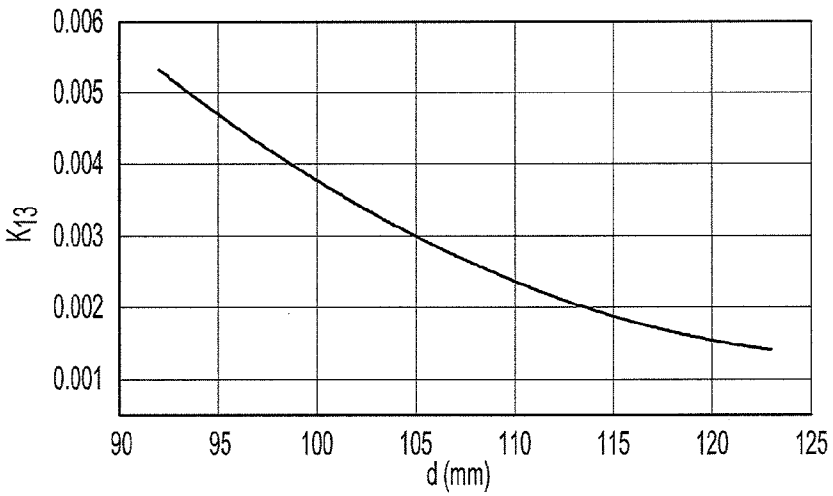
Figure 7:
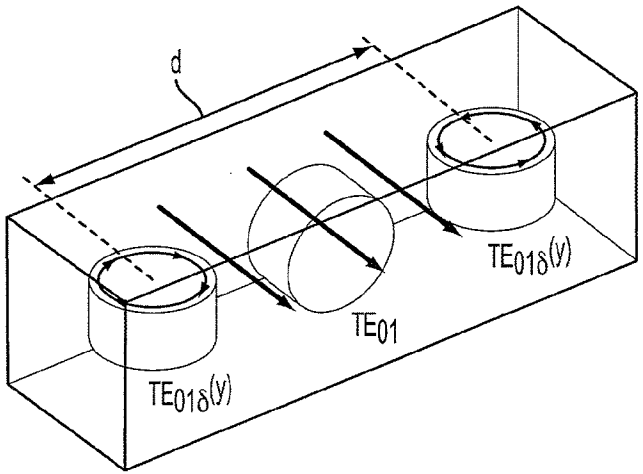

With reference to FIGS. 7, 8 and 9, once the waveguide cross-sectional dimensions are set, the distance d between the outer resonators is the main parameter to control the by-pass coupling $k_{13}$. Observe that the by-pass coupling primarily occurs through the $TE_{01}$ mode of the waveguide.

FIG. 9 shows the magnitude of the by-pass coupling coefficient $k_{13}$ versus the distance d for a fixed cross-sectional size. As d increases, the coupling $k_{13}$ decreases due to the decay of the evanescent $TE_{01}$ mode. Observe that no sequential coupling $k_{12}$ and $k_{23}$ are present in the structure of FIG. 7.

Figure 10:
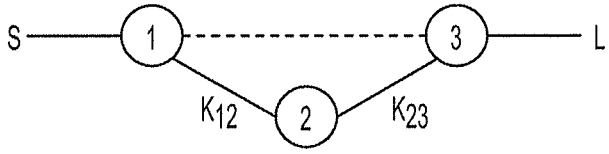
FIGS. 10 and 11 describe another form of electromagnetic coupling control for the triple resonator configurations of FIGS. 3A and 3B, in which the penetration distance, p, of a rod is varied, in accordance with an embodiment of the present invention.
Figure 11:
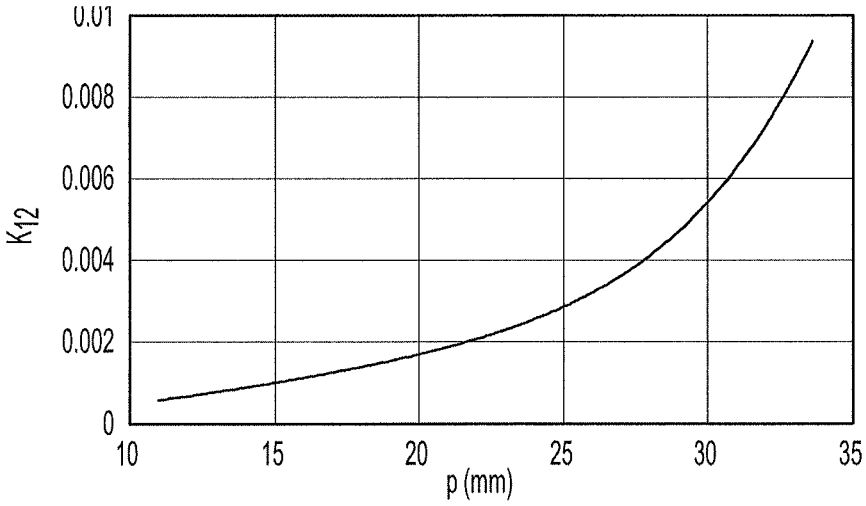

The sequential coupling coefficients $k_{12}$ and $k_{23}$ depicted in FIG. 10 are generated by inserting oblique metallic rods among the resonators. FIG. 3A shows a pair of oblique metallic rods (45°) inserted between resonators. The penetration p of the rod controls the coupling coefficient. FIG. 11 shows the magnitude of the coupling $k_{12}$ versus the penetration p for a fixed cross-sectional size. The more the penetration the stronger the coupling, as a stronger interaction between the $TE_{01}$ and $TE_{10}$ modes is generated through the oblique rod.

As previously described, the transmission zero can be moved to the other side of the passband by simply inverting the position of one of oblique rods as is shown in the structure of FIG. 3B. In this condition, the magnitude of the coupling coefficients remains basically unchanged, while the by-pass coupling sign is inverted.

Other embodiments that may be implemented by the present invention are shown in FIGS. 12A, 12B, 13A and 13B. These embodiments are additional basic building blocks for pseudoelliptic filters that are referred to herein as quadruple-resonator configurations. Each waveguide structure includes a cascade of four dielectric resonators, where the inner resonator pair is orthogonally oriented with respect to the outer resonator pair. The input port is designated as 125 and the output port is designated as 126.

Figure 12A:
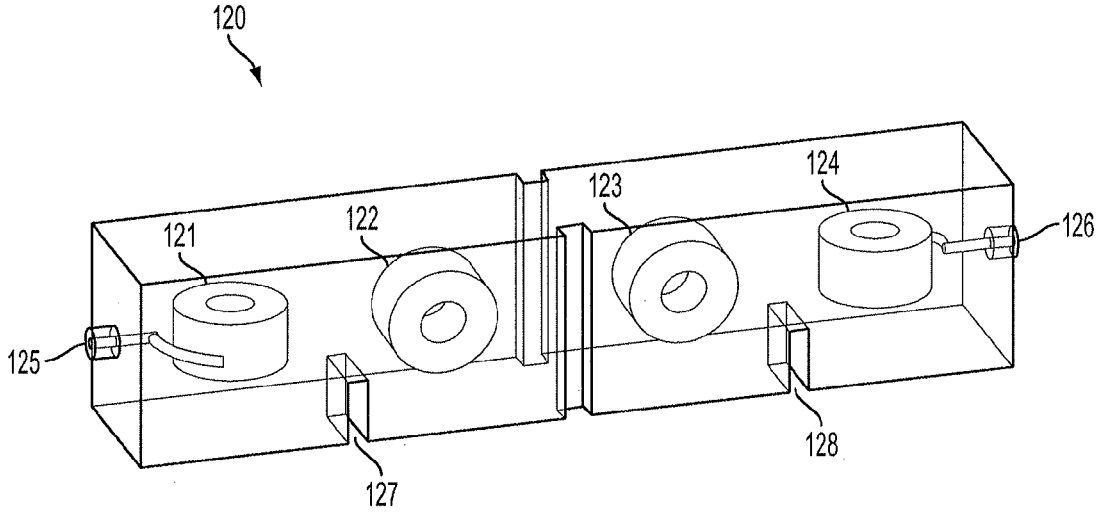
FIG. 12A is a perspective view of a quadruple resonator configuration in an evanescent waveguide with two waveguide steps realized at a corner of the waveguide (at the same side-wall), thereby providing positive coupling between the first and fourth resonator, in accordance with an embodiment of the present invention.
Figure 12B:
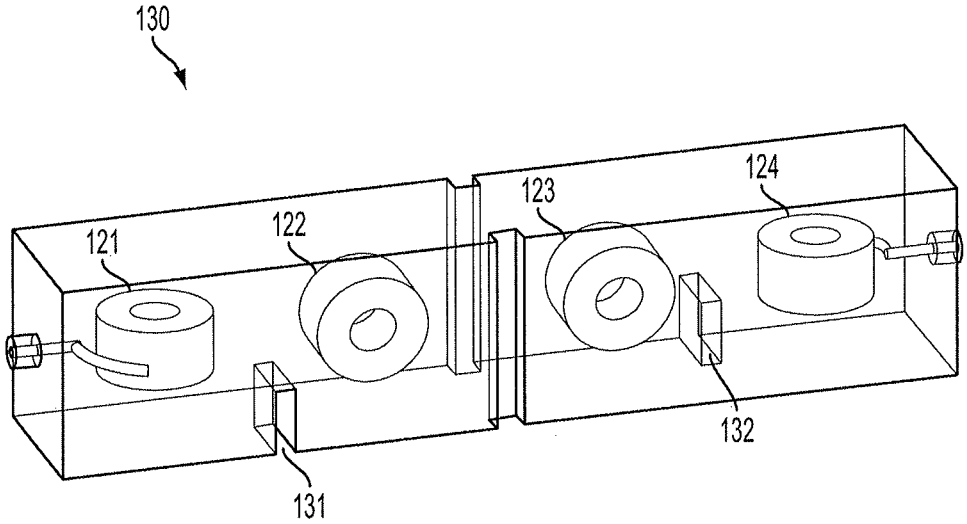
FIG. 12B is a perspective view of the same quadruple resonator shown in FIG. 12A, except that the two waveguide steps are inverted, as they are realized at different corners of the two opposite side-walls, thereby providing negative coupling between the first and fourth resonator, in accordance with an embodiment of the present invention.

It will be noted that ring-shaped resonators 121, 122, 123 and 124 (disk-shaped with a hole in the center) are used in the waveguide structures designated as 120 and 130 in FIGS. 12A and 12B, respectively. On the other hand, disk-shaped resonators 141, 142, 144 and 145 are used in the waveguide structures designated as 140 and 150 in FIGS. 13A and 13B, respectively. The resonators may also employ modes supported by other shapes with resonant eigen-mode solutions, such as rectangular parallopipeds, spheres, elliptical shapes, etc.

It will be appreciated that the waveguide structures need not be of rectangular cross-section, and may employ modes common to round or elliptical waveguides, with appropriate evanescent modes selected for coupling or bypassing the dielectric resonators contained within the respective waveguide structure.

Figure 12C:
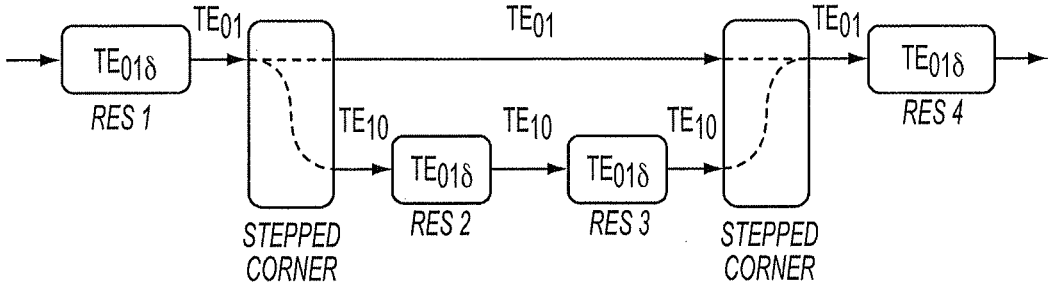
FIG. 12C is a schematic diagram showing the electromagnetic coupling among the various elements in the quadruple resonator configuration of FIGS. 12A and 12B, in accordance with an embodiment of the present invention.

The mode operation occurring within the waveguide structures of FIGS. 12A and 12B is illustrated by the block diagram in FIG. 12C. The first and last resonators are coupled by the evanescent $TE_{01}$ mode, which by-passes the second and third resonators. Stepped corners 127 and 128 formed on the same side-wall of waveguide structure 120 in FIG. 12A and stepped corners 131 and 132 formed on opposite side-walls of waveguide structure 130 in FIG. 12B are used in these embodiments to generate a coupling between the $TE_{01}$ and the $TE_{10}$ modes of the waveguide, as best shown in FIG. 12C. In this manner, a portion of the energy is transferred from the outer resonator pair to the inner resonator pair.

It will be noted that the stepped corners are similar to the oblique rods used in the triplet configurations of FIGS. 3A and 3B. The oblique rods may also be used instead of the stepped corners in FIGS. 12A and 12B. Thus, rods or stepped corners, or any other type of waveguide discontinuity may be used by the present invention to generate coupling mechanisms between orthogonal modes. It will also be appreciated that an additional waveguide discontinuity, such as an iris, may be used between the second and third resonators (which have the same orientation) to modulate the coupling occurring between them.

Figure 13A:
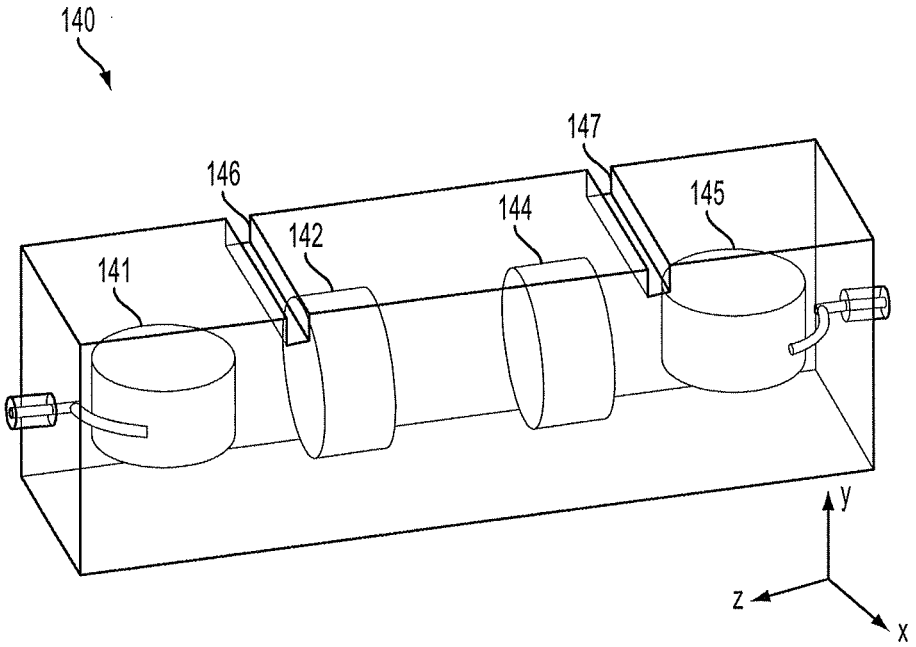
FIG. 13A is a perspective view of a quadruple resonator configuration in an evanescent waveguide with two waveguide steps realized at the top surface of the waveguide, thereby providing positive coupling between the first and fourth resonator, in accordance with an embodiment of the present invention.
Figure 13B:
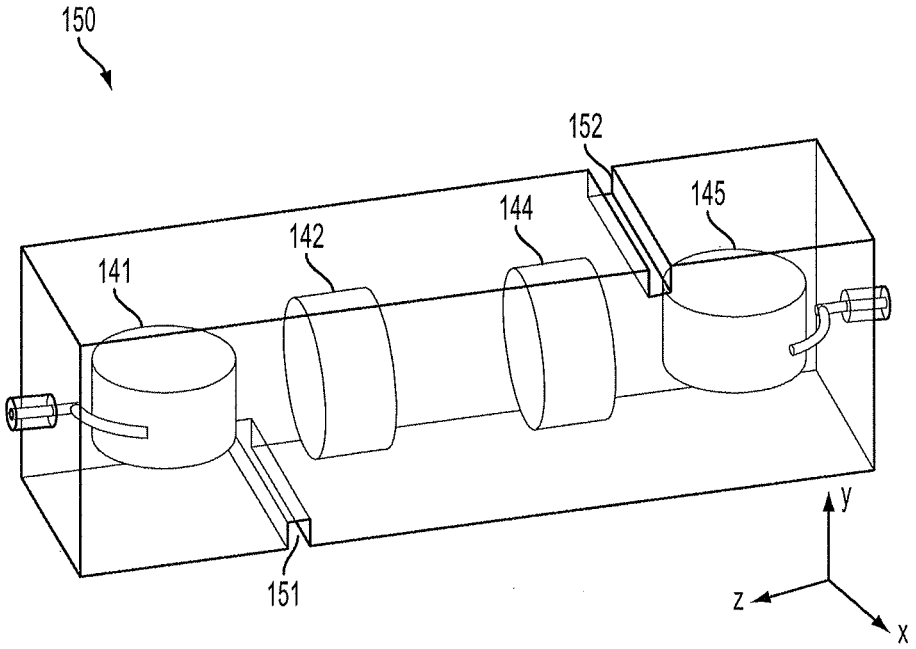
FIG. 13B is a perspective view of the same quadruple resonator shown in FIG. 13A, except that the two waveguide steps are inverted, as they are realized respectively at the bottom and top of the waveguide, thereby providing negative coupling between the first and fourth resonator, in accordance with an embodiment of the present invention.
Figure 13C:
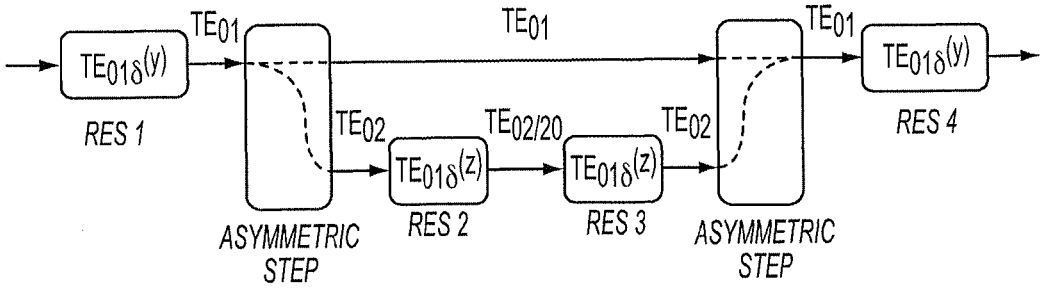
FIG. 13C is a schematic diagram showing the electromagnetic coupling among the various elements in the quadruple resonator configurations of FIGS. 13A and 13B, in accordance with an embodiment of the present invention.

The mode operation occurring within the waveguide structures of FIGS. 13A and 13B are illustrated by the block diagram in FIG. 13C. The first and last resonators are coupled by the evanescent $TE_{01}$ mode, which by-passes the second and third resonators. Asymmetric steps realized within the waveguide structure are used to generate a coupling between the $TE_{01}$ and the $TE_{02}$ modes of the waveguide. As shown, asymmetric steps 146 and 147 are formed on the same top surface of waveguide structure 140, while asymmetric steps 151 and 152 are formed on opposite top and bottom surfaces of waveguide structure 150. In this manner, a portion of the energy is transferred from the outer resonator pair to the inner resonator pair (rods may be also used for the same purpose).

The resulting topology shown in FIGS. 12A, 12B, 12C, 13A, 13B and 13C (also referred to as a quadruplet configuration) generates $4^{rd}$ order filtering functions with two zeros that may be located either on the imaginary axis of a complex plane (finite frequency transmission zeros), or on the real axis of the complex plane (group delay equalization), depending on the sign (negative or positive) of the by-pass coupling, as explained below.

Both positive and negative signs may be obtained by inverting the phase of the excited field at the outer resonators in the direct-path with respect to the phase of the by-passing mode. In practice, this may be accomplished by moving one of the stepped corners to the opposite waveguide side-wall, as shown in FIG. 12B, or by moving one of the asymmetric steps from the top to the bottom of the waveguide, as shown in FIG. 13B. The latter two configurations are also referred to herein as inverted steps, as compared to the parallel steps shown in FIG. 12A and FIG. 13A.

Figure 14A:
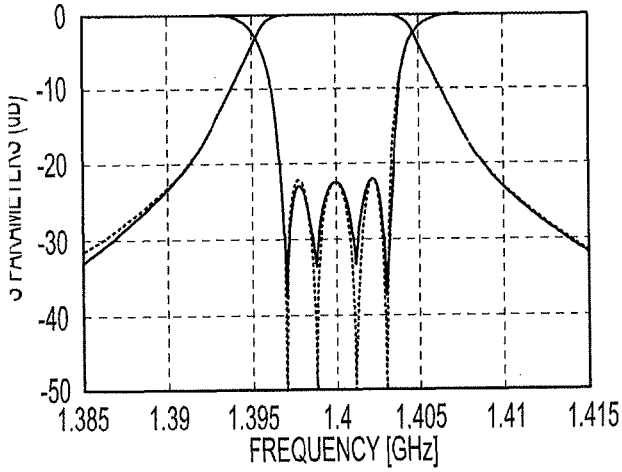
FIG. 14A is a plot of S parameters versus frequency for the quadruple resonator configurations shown in FIGS. 12A and 13A, in accordance with an embodiment of the present invention.
Figure 14B:
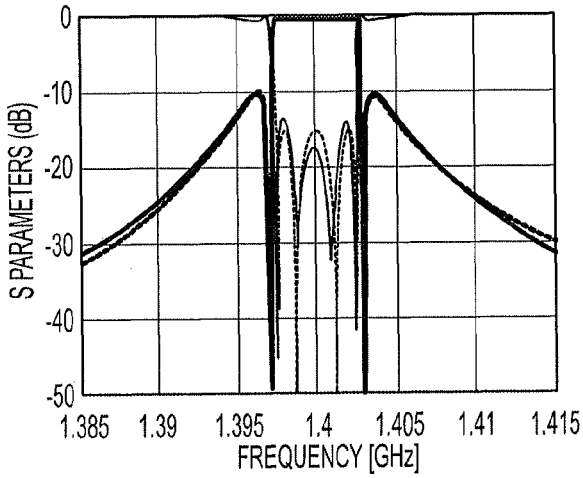
FIG. 14B is a plot of S parameters versus frequency for the quadruple resonator configurations shown in FIGS. 12B and 13B, in accordance with an embodiment of the present invention.

FIGS. 14A and 14B depict HFSS simulations (lossless) of the quadruple-resonator configurations. FIG. 14A shows the simulated S-parameters of the configurations depicted in FIGS. 12A and 13A (the quadruple-resonator configurations with parallel steps). FIG. 14B shows the simulated S-parameters of the configurations depicted in FIGS. 12B and 13B (the quadruple-resonator configurations with inverted steps).

The size of each step in FIGS. 12A, 12B, 13A and 13B adjusts the direct-coupling between two adjacent orthogonal resonators, namely, the larger the size of the step, the stronger the coupling. The distance between the resonators impacts the by-pass coupling without significantly affecting the direct-coupling. As a result, the position of the transmission zero may be adjusted while maintaining a consistent passband.

Figure 15:
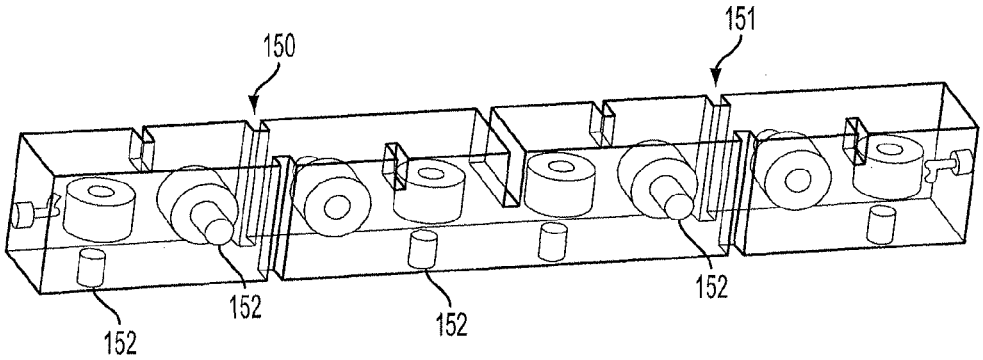
FIG. 15 is a perspective view of two-quadruple resonator configurations that are cascaded in-line, thereby providing an $8^{th}$ order filter, in accordance with an embodiment of the present invention.

In yet another embodiment of the present invention, FIG. 15 shows an $8^{th}$ order filter that uses two quadruplet configurations, designated as 150 and 151. The filter structure includes tuning elements, generally designated as 152 that may be inserted within each center hole of a respective disk shaped resonator (not labeled).

Figure 16:
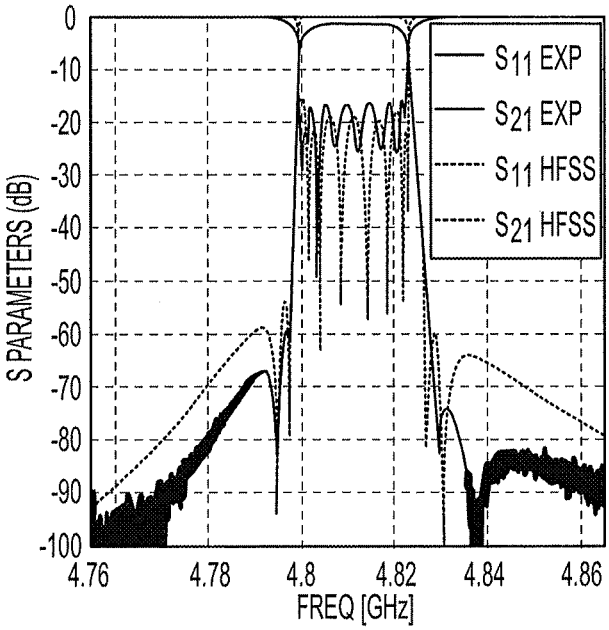
FIG. 16 is a plot of S parameters versus frequency for the two-quadruple resonator configurations shown in FIG. 15, including experimental results and simulated results, in accordance with an embodiment of the present invention.

An HFSS simulation (lossless) and an experimental result are shown in FIG. 16 for the $8^{th}$ order filter of FIG. 15. As an example, the filter has 0.457% fractional bandwidth at 4.810 GHz and provides high selectivity at both sides of the passband, due to two pairs of transmission zeros. High permittivity dielectric pucks with 15000 Q-factor may be included. As an example, the measured insertion loss is 1.40 dB at the filter center frequency (7000 cavity Q-factor).

Figure 17A:
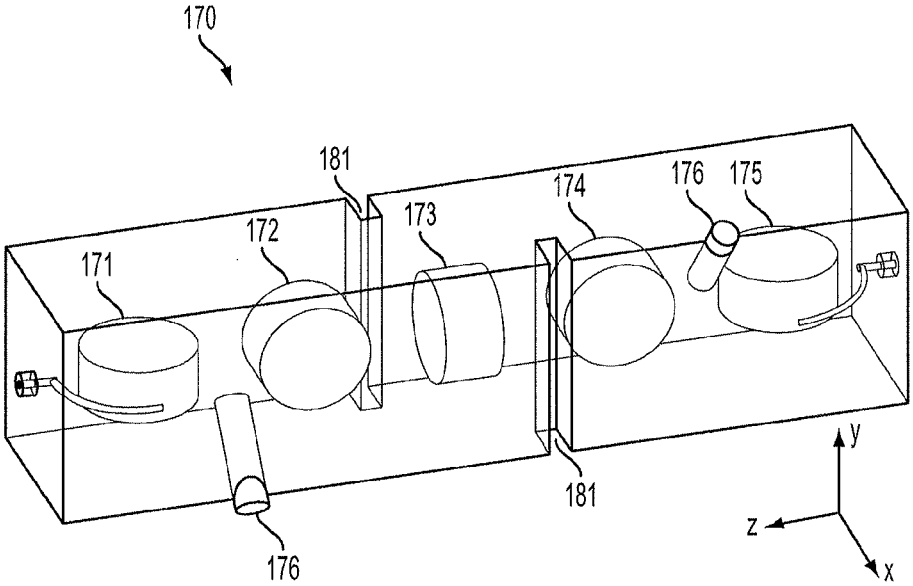
FIG. 17A is a perspective view of a quintuple resonator configuration in an evanescent waveguide with two waveguide steps realized at opposite sidewalls of the waveguide, thereby providing negative coupling between the second and fourth resonators, and a positive coupling between the first and fifth resonators, in accordance with an embodiment of the present invention.
Figure 17B:
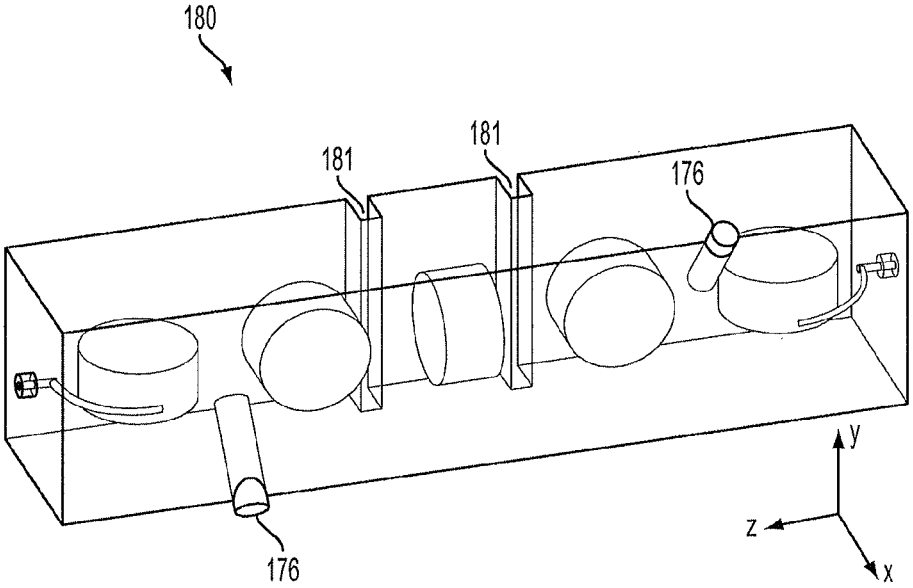
FIG. 17B is a perspective view of the same quintuple resonator configuration shown in FIG. 17A, except that the two waveguide steps are realized at the same sidewall of the waveguide, thereby providing positive coupling between the second and fourth resonator, and negative coupling between the first and fifth resonator, in accordance with an embodiment of the present invention.

Still more embodiments of the present invention are shown in FIGS. 17A and 17B. These embodiments are additional basic building blocks for pseudoelliptic filters that are referred to herein as quintuple-resonator configurations designated, respectively, as 170 and 180. Each structure includes a cascade of five dielectric resonators, namely 171, 172, 173, 174 and 175, where the inner most resonator 173 is orthogonally oriented with respect to the other resonators, and where the second and fourth resonators 172, 174 are orthogonally oriented with respect to the first and fifth resonators 171, 175.

Figure 17C:
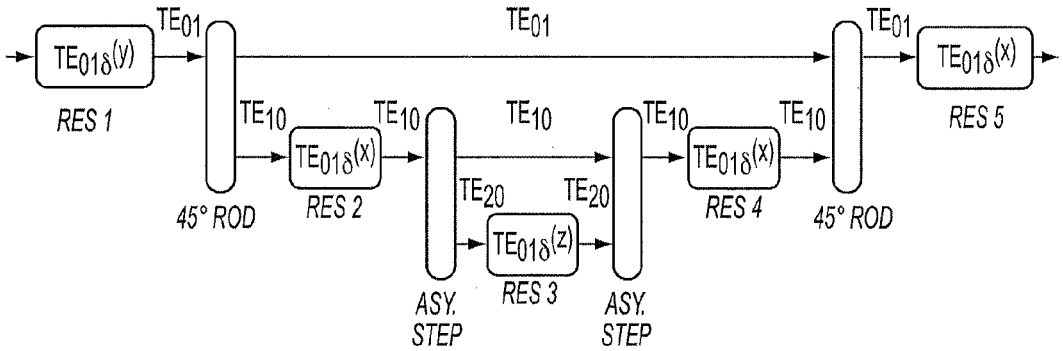
FIG. 17C is a schematic diagram showing the electromagnetic coupling among the various elements in the quintuple resonator configurations of FIGS. 17A and 17B, in accordance with an embodiment of the present invention.

The mode operation occurring within the waveguide structures of FIGS. 17A and 17B is illustrated by a block diagram in FIG. 17C. As shown, the first and last resonators are coupled by the evanescent $TE_{01}$ mode, which by-passes the second, third and fourth resonators. The second and fourth resonators are coupled one to the other by the evanescent $TE_{10}$ mode which by-passes the third resonator. First and second resonators (as well as fourth and fifth resonators) are coupled to each other by oblique metallic rods 176, which generate an interaction between the $TE_{01}$ and the $TE_{10}$ modes. The third resonator is coupled to the second and fourth resonators by asymmetric steps 181, which generate an interaction between the $TE_{10}$ and the $TE_{20}$ modes.

The resulting topology depicted in FIGS. 17A, 17B and 17C, which may be referred to as a quintuplet configuration, generates $5^{th}$ order filtering functions with three finite frequency transmission zeros.

The relative position of the asymmetric steps with respect to each other, determines the signs of the by-pass coupling coefficients. The structure 170 in FIG. 17A, in which steps 181 are realized on opposite waveguide sidewalls (inverted steps), yields a negative sign for the by-pass coupling between the second and fourth resonator, while giving a positive sign for the by-pass coupling between the first and the fifth resonator. On the other hand, structure 180 in FIG. 17B, in which the two asymmetric steps are realized on the same waveguide sidewall (parallel steps), yields a positive sign for the by-pass coupling between the second and fourth resonator while giving a negative sign for the by-pass coupling between the first and the fifth resonator.

As previously described for the triple and quadruple configurations, the size of each step 181 and each oblique rod 176 in FIGS. 17A and 17B adjusts the direct-coupling between two adjacent orthogonal resonators, while the distances between the resonators impacts the by-pass coupling coefficients.

Figure 18A:
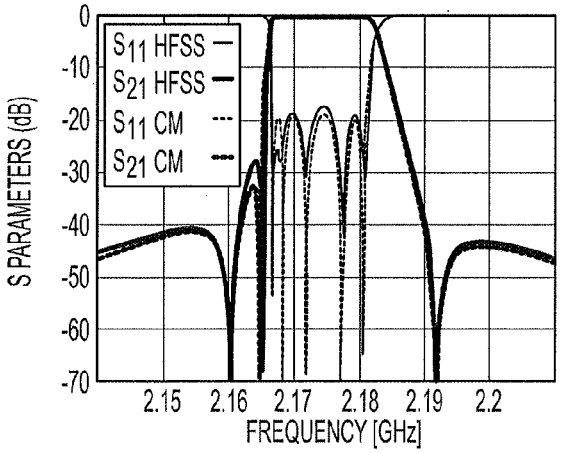
FIG. 18A is a plot of S parameters versus frequency for the quintuple resonator configuration shown in FIG. 17A, including experimental results and simulated results, in accordance with an embodiment of the present invention.
Figure 18B:
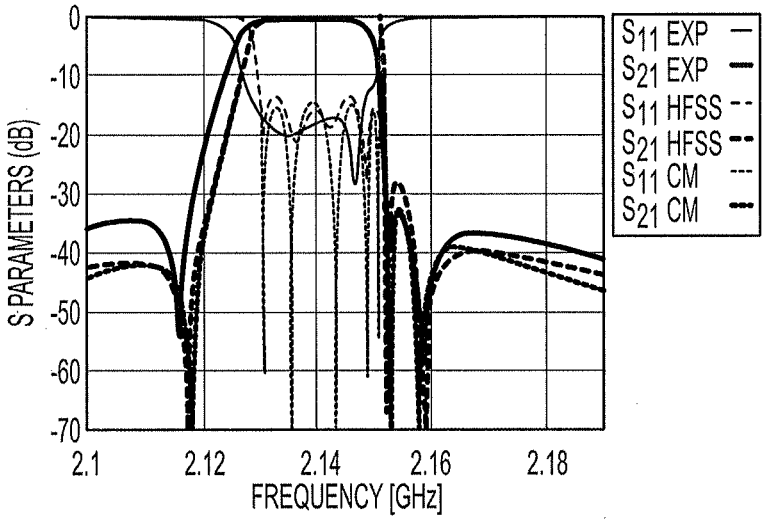
FIG. 18B is a plot of S parameters versus frequency for the quintuple resonator configuration shown in FIG. 17B, including experimental results and simulated results, in accordance with an embodiment of the present invention.

FIGS. 18A depicts the HFSS simulation (lossless) and measurements of the quintuple-resonator configuration in FIG. 17A (configuration with inverted steps). FIGS. 18B depicts the HFSS simulation (lossless) and measurements of the quintuple-resonator structure configuration of FIG. 17B (configuration with parallel steps).

It will be understood that the waveguides may be circular, rather than square. In the embodiments described, the waveguides were shown as square or rectangular. In addition, although in the embodiments two modes were generally described, nevertheless, there may be an infinite number of modes that contribute to the excitation of the resonators. It is more accurate to state that the resonator may be excited substantially by a particular mode, but may include additional modes.

Furthermore, the resonators do not need to be 100% orthogonal to each other. In general, the resonators may be differently oriented from each other. When the resonators are 100% orthogonal along one of the three axes, the properties of the structure are optimized from certain perspectives, but the present invention still works when the resonators are only partially orthogonal to each other.

Moreover, the resonators are electromagnetically uncoupled from each other only if the resonators are 100% orthogonal and if no perturbations are introduced in the waveguide. This condition typically would not occur, as there needs to be an electromagnetic coupling between the resonators. The perturbations allow the generation of an interaction between the waveguide modes which excite each of the resonators. Thus, the resonators are coupled to each other and the purpose of the perturbations is to control the amount of coupling between them.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A filter comprising:

an evanescent mode waveguide formed along a straight line and configured to operate in at least two transverse electric (TE) waveguide modes, a first TE mode dielectric resonator disposed in the waveguide, wherein the first TE mode dielectric resonator is configured to be excited by one of the at least two TE waveguide modes, and has an excited field oriented in a first plane that intersects with the straight line, and a second TE mode dielectric resonator disposed in the waveguide, wherein the second TE mode dielectric resonator is configured to be excited by the other one of the at least two TE waveguide modes, the second dielectric resonator having an excited field oriented in a second plane that intersects with the straight line, wherein the first and second planes intersect the straight line at different angles.

2. The filter of claim 1 including:

a third TE mode dielectric resonator disposed in the waveguide and configured to be substantially excited by the same waveguide mode as the first TE mode dielectric resonator, the third TE mode dielectric resonator having an excited field oriented in a third plane that intersects with the straight line, wherein the first and third planes are substantially parallel to each other.

3. The filter of claim 2 wherein:

the second TE mode dielectric resonator is disposed between the first and third dielectric resonators, the second TE mode dielectric resonator is electromagnetically coupled to the first and third TE mode dielectric resonators, and the first and third TE mode dielectric resonators are electromagnetically coupled to each other.

4. The filter of claim 3 including an input probe, or other interface for exciting the first TE mode dielectric resonator.

5. The filter of claim 3 including an output probe, or other interface for exciting the third TE mode dielectric resonator.

6. The filter of claim 3 including:

a first perturbation element extending from an external surface of the waveguide into the waveguide, the first perturbation element disposed between the first and second TE mode dielectric resonators, and a second perturbation element extending from the external surface of the waveguide into the waveguide, the second perturbation element disposed between the second and third TE mode dielectric resonators, wherein the first and second perturbation elements are configured to excite the second TE mode dielectric resonator in the other one of the at least two TE waveguide modes.

7. The filter of claim 6 wherein:

the first perturbation element is a first metallic rod oriented at a positive or negative angle with respect to the first TE mode dielectric resonator, and the second perturbation element is a second metallic rod oriented at a positive or negative angle with respect to the third TE mode dielectric resonator.

8. The filter of claim 7 wherein the first and second metallic rods are substantially oriented at a positive or a negative 45 degree angle with respect to the first and third TE mode dielectric resonators, respectively.

9. The filter of claim 7 wherein:

the first and second metallic rods penetrate into the waveguide a penetration distance p, wherein the penetration distance p is long enough to be effective in controlling an amount of electromagnetic coupling between the first and second TE mode dielectric resonators, and between the second and third TE mode dielectric resonators, respectively, and the longer the penetration distance p, the greater the amount of electromagnetic coupling between the first and second TE mode dielectric resonators, and between the second and third TE mode dielectric resonators, respectively.

10. The filter of claim 3 wherein:

a distance, d, separates a center of the first TE mode dielectric resonator from a center of the third dielectric resonator, wherein the distance d is short enough to be effective in controlling an amount of electromagnetic coupling between the first and third TE mode dielectric resonators, and the shorter the distance d, the greater the amount of electromagnetic coupling.

11. The filter of claim 3 wherein:

the first, second and third TE mode dielectric resonators are cascaded along the straight line of the waveguide to form a first triple-resonator configuration, and the filter further includes:

a second triple-resonator configuration disposed in line with the first triple-resonator configuration to form two triple-resonator configurations in cascade.

* * * * *